United States Patent [19]

Sasaki et al.

[11] 4,082,540

[45] Apr. 4, 1978

[54] MATERIAL FOR SINTERING EMITTING A LESSER AMOUNT OF NITROGEN OXIDE AND A METHOD FOR MANUFACTURING THE SAME

[75] Inventors: Minoru Sasaki, Yokohama; Yukihiro Hida; Tsuneo Enokido, both of Kawasaki; Kaoru Ito, Yokohama, all of Japan

[73] Assignee: Nippon Steel Corporation, Tokyo, Japan

[21] Appl. No.: 710,382

[22] Filed: Aug. 2, 1976

Related U.S. Application Data

[62] Division of Ser. No. 537,533, Dec. 30, 1974, Pat. No. 4,001,007.

[51] Int. Cl.[2] ..... C22B 1/08; C22B 1/24; C22B 1/16

[52] U.S. Cl. ..... 75/3; 75/4; 75/5

[58] Field of Search ..... 75/3-5

[56] References Cited

U.S. PATENT DOCUMENTS

| | | | |
|---|---|---|---|
| 3,134,667 | 5/1964 | Holowaty | 75/3 |
| 3,163,519 | 12/1964 | Hanson | 75/3 |
| 3,169,852 | 2/1965 | Price | 75/3 |
| 3,721,548 | 3/1973 | Hodge | 75/3 |

*Primary Examiner*—P. D. Rosenberg
*Attorney, Agent, or Firm*—Watson, Leavenworth, Kelton & Taggart

[57] ABSTRACT

A material for sintering capable of emitting a lesser amount of nitrogen oxide during sintering thereof to produce a sintered ore. It is composed of finely divided coke concentrated within a predetermined range in an outer shell layer of agglomerated particles.

3 Claims, 8 Drawing Figures

(EXAMPLE OF CALCULATION OF OPTIMUM AMOUNT OF WATER: AMOUNT OF SATURATED WATER x 0.6)

MATERIAL FOR SINTERING EMITTING A LESSER AMOUNT OF NITROGEN OXIDE AND A METHOD FOR MANUFACTURING THE SAME

This is a division of application Ser. No. 537,533, filed Dec. 30, 1974, now U.S. Pat. No. 4,001,007.

BACKGROUND OF THE INVENTION

This invention relates to a material for sintering or a sintering material for producing a sintered ore which emits an exhaust gas having a small content of nitrogen oxide during sintering said material.

Sintered ore is an essential material for iron making when it is desired to effect mass production of pig iron of good quality in a large blast furnace. The sintered ore can be manufactured by mixing powdered ores, lime stone, coke and fines, allowing the coke in the mixture to burn and baking the mixture by means of combustion heat. In this case, NOx or the various nitrogen oxides is discharged in the exhaust gas during sintering. Recently, it has been considered that this NOx is the main substance which gives rise to photochemical smog, and it is a serious concern to prevent or reduce the emission of the NOx thereby reducing pollution emission to the atmosphere.

It is therefore an object of the invention to provide a material for sintering capable of preventing the emission of the NOx without resort to a great change in the method and apparatus for sintering now used.

DESCRIPTION OF THE PRIOR ART

In order to decrease the amount of NOx discharged into the atmosphere, there have been proposed two methods. One method is to remove the NOx by converting the emitted NOx into other compound by means of physical or chemical treatments, and the other method is to suppress the emission of the NOx as far as possible. As for the latter method, there are two ways. One is to change or improve the process and the other is to change the composition of the material.

SUMMARY OF THE INVENTION

This invention is directed to prevention of the emission of the NOx during manufacture of sintered ore by means of the structure of the material used for sintering.

When a conventional, typical material as shown in Table 1 is adjusted with respect to its moisture to produce an ordinary material which has become agglomerated particles or pseudo granules and these particles are scraped of their attached powder to effect the macro observation of nucleus particles and the classification, the agglomerated particles can be classified into the S type, C type and P type depending upon the condition of existence of the coke as follows:

S type: The coke particles of at least 1 mm constitute a nucleus and the fine powders of not more than 1 mm such as powdery iron ores, powdery coke, powdery lime stone, etc. form an outer shell or layer.

C type: The material for sintering (the iron ore, fines, lime stone, etc.) except for the coke of at least 1 mm constitutes the nucleus and the fine powders of not more than 1 mm such as powdery iron ores, powdery coke, powdery lime stone, etc. form the outer shell layer.

P type: The agglomerated particles consisting of powdery iron ore, powdery coke, powdery lime stone, etc. and having no nucleus, which thus shows poor strength.

Table 1

| | Mixing ratio | Distribution (%) of Particle Size | | | | | | | | Averge particle size |
|---|---|---|---|---|---|---|---|---|---|---|
| | | 10−5 | −3 | −2 | −1 | −0.5 | −0.25 | −0.125 | 0.125− | |
| iron ore | 58.8 | 6.8 | 11.9 | 8.4 | 14.9 | 14.0 | 12.0 | 20.5 | 11.5 | 1.62 |
| fines | 30.5 | 11.8 | 42.5 | 16.6 | 13.0 | 6.8 | 3.5 | 2.6 | 3.2 | 3.27 |
| coke | 3.1 | 3.4 | 12.2 | 10.0 | 17.2 | 16.4 | 13.4 | 11.4 | 16.0 | 1.46 |
| lime stone | 7.6 | 0.3 | 4.9 | 21.1 | 29.1 | 20.9 | 10.0 | 5.2 | 8.5 | 1.40 |
| material mixed | 100.0 | 7.7 | 20.7 | 11.9 | 15.5 | 12.4 | 9.3 | 13.6 | 8.9 | 2.09 |

Moreover, the S type, C type and P type particle has some relation with the particle size of the agglomerated particles, the distribution of the particle size of the agglomerated particles being indicated in Table 2, from which it is noted that the agglomerated particles of at least 2 mm are composed of the S type and the C type and the agglomerated particles of not more than 1 mm are composed of the P type.

Table 2

| Particle size | Distribution rate | Classification of forms of agglomerated particles |
|---|---|---|
| 10 - 4.76$^{mm}$ | 18.3% | S type, C type |
| 4.76 - 2 | 44.9 | |
| 2 - 1 | 21.1 | P type + C type (difficult to discriminate) |
| 1 - 0.5 | 10.4 | |
| 0.5 - 0.25 | 4.2 | P type |
| 0.25 - | 1.1 | |

As a result of observation on the agglomerated particles of at least 2 mm, of which the kind of the nucleus particles is clear, the distribution of the particle size of the attached or coated powders are such that the particles of at least 1 mm in the material constitute the nucleus particle and the particles of not more than 1 mm constitute the outer shell layer as shown in Table 3. Accordingly, when the ordinary material for sintering which consists of the typical materials as shown in Table 1 is classified into the agglomerated particles of the S, C and P types and the ratio of the existing coke, the result is shown in Table 4.

Table 3

| Particle size of agglomerated particles | 10 - 4.76 mm | | | 4.76 - 2.0 mm |
|---|---|---|---|---|
| Kind of nucleus | Iron Iron ore | Fines | Whole nucleus particles | Whole nucleus particles |
| 1 - 0.5 $^{mm}$ | 3.7% | 4.1% | 4.0% | 0.0% |
| 0.5 - 0.149 | 29.7 | 30.9 | 30.5 | 28.4 |
| 0.149 - 0.105 | 14.5 | 14.9 | 14.7 | 15.4 |
| 0.105 - 0.063 | 14.6 | 14.0 | 14.2 | 18.7 |
| 0.063 - 0.044 | 10.0 | 9.7 | 9.8 | 11.9 |
| 0.044 - | 27.5 | 24.5 | 26.8 | 25.6 |

Table 4

| S type | C type | P type |
|---|---|---|
| 44.2% | 33.2% | 22.6% |

The condition of emission of the NOx in the manufacture of the ordinary sintered ore using the above typical materials, or the amount of NOx emitted and the rate of NOx converted (rate % of N converted into NOx in the material coke) in the existing sintering machine is shown in Table 5.

Table 5

| | Sinter production | Coke used | NOx* emitted | Rate of conversion | $m^3$-NO t-sinter |
|---|---|---|---|---|---|
| A plant | $739.5^{t/H}$ | $47.3^{Kg/T}$ | $226.1^{m3/H}$ | 40.4% | 0.3057 |
| B plant | 425.4 | 56.8 | 147.3 | 38.1 | 0.3462 |

*The NOx which is generated from the combustion by burners in the ignition furnace and the heat-reserving furnace is excluded.

In the manufacture of the sintered ore, the coke which is one of the materials is allowed to burn and the amount of heat thus emitted will bake the powdered ore etc., which brings about an atmosphere of high temperature such as 1400° C or so. Consequently, two routes can be considered. That is, one route is that the nitrogen oxide is produced by combination of $N_2$ in the air with $O_2$ at high temperature, and the other route is that the nitrogen oxide comes from the oxidation of the N which is contained in the coke ordinarily in an amount of 1% or so. Analysis of the exhaust gas from sintering shows that more than 95% of NOx is NO even when measured in the flue. Thus it is considered that the nitrogen oxide immediately after generated in the course of combustion of coke is almost NO. Furthermore, the study of the inventors confirmed that the NO generated in the course of manufacturing the sintered ore is the so-called "Fuel NO" which has been converted from the N included in the material coke.

The mechanism of generating the Fuel NO is as follows:

The N in the coke which will be the origin of the Fuel NO becomes an atomic nitrogen (N*) through thermal decomposition and is thereafter converted into NO or $N_2$ according to the following reactions.

$$N^* + N^* \rightarrow N_2 \quad (1)$$

$$N^* + 1/2O_2 \rightarrow NO \quad (2)$$

A part of the NO once formed is reduced with CO to give $N_2$.

$$2NO + 2CO \rightarrow 2CO_2 + N_2 \quad (3)$$

Accordingly, in order to control the NO, it is necessary to control the reaction (2) while promote the reaction (3), wherein it is seen that the reaction (3) is particularly significant.

As a result of various tests using various materials, it has now been found that in order to accelerate the reaction (3) it is effective to form a gas film of high CO concentration on the surface of the burning coke whereby the atomic N which is emitted simultaneously with the combustion is prevented from reaction with $O_2$ and the NO obtained is reduced in the film of high CO.

A method for accelerating the reaction (3) is as follows:

(1) The particle size of the coke is made finer so as to narrow the gap between cokes.

(2) The ratio of coke/gas contacted is made greater.

(3) The high temperature is given since the reaction (3) is an endothermic reaction, etc.

From the above studies, it has been discovered that the composite structure wherein the finely divided coke is concentrated on the surface of the nucleus particles, such as ores in the coarse particle form, is suitable as the material for sintering which is capable of preventing the emission of NOx.

According to this invention, there is provided a material for sintering emitting a lesser amount of nitrogen oxide which comprises such sintering materials for iron making as powdery iron ore, fines ("fines" being as those skilled in the art will readily discern, iron bearing materials which are the residue of furnace sintering charges which are too small for introduction into the furnace), powdery lime stone, powdery coke and so on and has a composite structure consisting of ore nucleus materials and an outermost shell layer, the central nucleus of said ore nucleus materials consisting of any substance of the materials other than the coke and having a particle size between 1 and 10 mm, the concentration of the coke in said outermost shell layer satisfying the following formula:

$$40 \geqq C \geqq /(100\text{-}b) \times 100 \quad (4)$$

wherein *a* is the weight % of the coke in the whole sintering materials; *b* is the weight % of the particles having the size of at least 1 mm in the whole sintering materials; and C is the concentration (%) of the coke in the outermost shell layer.

Regarding the agglomerated particles of this invention, some of them have ore nucleus particles consisting of a central nucleus and an intermediate layer and others have ore nucleus particles consisting only of the central nucleus. The weight ratio of the coarse particles for the central nucleus to the fine particles for the attached powders varies with the ores used. The ratio of the fine particles to the coarse ones is comparatively greater for the ordinary material for sintering. In case of this invention, the structure of the agglomerated particle can be determined by the ratio of the coarse particles which is to constitute the central nucleus and by the concentration of the coke required for the outermost shell layer. The coke exists only in the outermost shell layer and the other materials such as iron ore, fines, lime stone, etc. are distributed as structure elements for the central nucleus and the outermost shell layer.

According to this invention, there is also provided a material for sintering emitting a lesser amount of NOx which comprises such sintering materials for iron making as powdery iron ore, fines, powdery lime stone, powdery coke and so on, wherein {the weight ratio (%) of the coke to form the C type particles in the entire coke} $\geqq 60 + 0.5 \times$ {the weight ratio (%) of the coke to form the S type particles in the entire coke}, and {the weight ratio (%) of the coke to form the S type particles in the entire coke} $\leqq 20$, in which the S type is the agglomerated particles wherein the coke of at least 1 mm forms the central nucleus and around said nucleus the fine powders of not more than 1 mm such as iron ores, coke, lime stone, etc. attach and form the outer shell layer; and the C type is the composite type agglomerated particles wherein the sintering materials (iron ore, lime stone, etc.) of at least 1 mm except for coke form the central nucleus and around the nucleus the fine powders of not more than 1 mm, such as iron ore, lime stone, etc. except for coke attach and form the intermediate layer and further around said intermediate layer the fine powders of not more than 1 mm such as iron ore, coke, lime stone, etc. attach and form the outer shell layer, or the C type is the composite type agglomerated particles in which the fine powders of not more than 1 mm such as iron ores, coke, lime stone, etc. attach around the above central nucleus and form the outer shell layer.

According to this invention, there is further provided a method for manufacturing a material for sintering emitting a lesser amount of NOx during the sintering treatment which comprises mixing (a) powdery iron ore and (b) fines, with or without addition of (c) lime stone thereto, in the primary, pelletizer or mixer to produce the ore nucleus materials, mixing (a) coke of not more than 1 mm and (b) powdery iron ore of not more than 1 mm, with or without addition of (c) lime stone of not more than 1 mm to produce the material for the outermost shell layer, and mixing the ore nucleus material and the material for the outermost shell layer in the secondary pelletizer or mixer; and a method for manufacturing a material for sintering emitting a lesser amount of NOx which comprises granulating powdery coke of not more than 1 mm and other sintering materials with an amount of added water smaller than the optimum amount to prevent the formation of the P type particles, rolling the discharge from the primary pelletizer with the remaining amount of water added in the secondary pelletizer so as to attach the ungranulated fine powder in said discharge to the composite type particles in said discharge.

The latter method is intended to manufacture a material for sintering wherein at least 60% of the entire coke is alloted to the composite type particles (C type) which have the central nucleus formed by the coarse particles of lime stone and iron ores and have the outer shell layer formed by fine particles of coke and iron ores, while not more than 40% of the entire coke is alloted to the pellet type particles (P type) which have no nucleus in the center.

According to this invention, there is still further provided a method for manufacturing a material for sintering emitting a lesser amount of NOx which comprises adding primary water to the sintering materials such as powdery iron ore, lime stone, fines to granulate the same in the primary pelletizer, passing the resulting granules and the coke of not more than 1 mm into the secondary pelletizer to roll the same with the secondary water added and thereby diffuse the coke from the surface of the granules to the inside thereof.

DESCRIPTION OF THE PREFERRED EMBODIMENTS

Table 3 clearly shows that as the nucleus particle is smaller, the attached powder particles are also smaller. When the nucleus particle is too large, the heat caused by the combustion of the coke can not be transmitted well into the inner part of the nucleus particle, which gives rise to insufficient baking.

Accordingly, it is necessary that the central nucleus particles should be in the range between 10 and 1 mm, and preferably, between 5 and 1 mm from the view point of production yield. For these central nucleus of 5 to 1 mm, the attached powder which constitutes the intermediate layer and the outermost shell layer should preferably be 0.5 mm or less.

The effect of preventing NOx with varied ratio of the coke mixed in the outermost shell layer was tested as follows.

As the influence caused by the kind of ores used is negligible, Swaziland ore was used as a typical example. The mixing ratio of materials is shown in Table 6 which is based on the standard mixing of materials.

Table 6

| Materials | Particle size | Mixing ratio |
|---|---|---|
| Swaziland ore | 1 - 5 mm | 40% |
| Swaziland ore | not more than 1 mm | 46% |
| Lime stone | not more than 1 mm | 10% |
| Coke | not more than 1 mm | 4% |

The Swaziland ore of not more than 1 mm and lime stone of not more than 1 mm are mixed, which are then divided into two groups. One group is what is for forming the intermediate layer and the other is for forming the outermost shell layer. These fine powders which are to be the intermediate layer and the Swaziland ore of 1 to 5 mm are well mixed, and granulated with moisture adjusted to give the ore nucleus particles. Then the mixture of lime stone and the ore which is to be the outermost shell layer is further mixed with coke of not more than 1 mm so that agglomerated particles of the composite type is formed. The comparison of when these agglomerated particles are sintered in the 60 Kg sintering pan and that when the general standard materials shown in Table 3 are sintered in the same sintering pan is shown in Table 7.

Table 7

| Material | Yield | Amount of NOx per sintered product |
|---|---|---|
| Control (material shown in Table 3) | 74.1% | $0.354m^3/T$ |
| Composite-type* (material shown in Table 6) | 76.4% | $0.151m^3/T$ |

*Concentration of coke in the outermost shell layer: 10%

The above Table shows that if the concentration of the coke in the outermost shell layer is allowed to exceed 10%, the NOx emitted can be made less than ½ of that resulting from prior methods.

Figure 1:
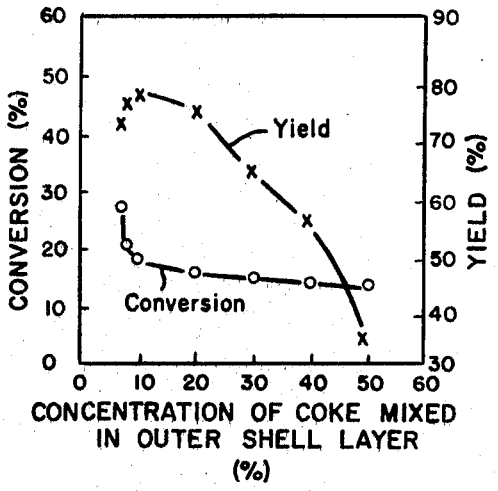
FIG. 1 is a graph depicting the result of the test for sintering with varied concentration of the coke existing in the outer shell layer of the C type particles.

FIG. 1 shows the relation of the concentration of the coke in the outermost shell layer with the amount of NOx emitted (indicated by conversion rate of N in the coke to NO) and with the yield of the sintered ore product. It is obvious from this result that the conversion rate of N in the coke to NO can successfully be lowered to ⅔ or less as distinguished from that of the general standard materials shown in Table 3. The conversion rate is lowered with the increase of the concentration of the coke in the outermost shell layer, and it is possible to decrease the emission of NOx down to ½ or less of that of known methods if the concentration of the coke in the outermost shell layer is increased to at least 10%. Thus, the ratio of the coke in the outermost shell layer should be as high as possible from the viewpoint of preventing the emission of NOx. In the range exceeding 10%, however, there is no appreciable difference in the effect.

The yield reaches maximum when the concentration of the coke in the outermost shell layer is about 10%, and if said concentration increases further, the yield begins to decrease. If the concentration of the coke in said layer is not more than 20%, the yield which is equal to, or more than, that of the general standard materials can be expected. If said concentration exceeds 40%, the yield becomes 50% or less, which is not practical in terms of cost.

Consequently, it is necessary to confine the concentration of the coke in the outermost shell layer into the range which is more than the concentration required to give the composite-type structure and yet is less than 40%. Thus the concentration of the coke in the outermost shell layer which is preferable from the point of the effect of preventing the emission of NOx and the yield may be 10 to 20%. It is, however, not always necessary that the distribution of the concentration of the coke in the outermost layer should be uniform. Further, it is noted that the yield can be increased if a binder is used in the course of the granulation step, particularly when the intermediate layer is formed and the ore nucleus particles are formed.

The invention regarding formulae 5*a* and 5*b* is as follows:

From the materials of powder ore, lime stone and coke, the sintering materials of the S, C and P types having the particle size and the mixing ratio shown in Table 8 was prepared.

Table 8

| Type | | Coarse powdery ore | Fine powdery ore | Lime stone | Coarse powdery coke | Fine powdery coke |
|---|---|---|---|---|---|---|
| S | Particle size | 1 – 5mm (average 3.1mm) | 1mm or less (average 0.13mm) | 1mm or less (average 0.17mm) | 1 – 5mm (average 2.3mm) | 1 mm or less (average 0.14mm) |
| | Mixing ratio | 40% | 46% | 10% | 3.8% | 0.2% |
| C | Particle size | 1 – 5mm (average 3.1 mm) | 1mm or less (average 0.13mm) | 1mm or less | | 1mm or less (average 0.14mm) |
| | Mixing ratio | 40% | 46% | 10% | 0 | 4% |
| P | Particle size | | 1mm or less (average 0.13mm) | 1mm or less (0.17mm) | | 1 mm or less (average) 0.14mm) |
| | Mixing ratio | 0 | 86% | 10% | 0 | 4% |

The way of preparing the respective samples of S, C and P types is as follows.

S type: Lime stone and fine powdery iron ore as well mixed. An amount of the resulting mixture corresponding to 2% of the sintering material is mixed with the fine powdery coke. The resulting fine powder with its moisture adjusted is attached to the surface of the coarse powdery coke to form the agglomerated particle S'. The remaining mixed powders of lime stone and fine powdery iron ore with their moisture adjusted are attached to the surface of the coarse powdery coke to form the agglomerated particle S". The agglomerated particles S' and S" are mixed to give the sintering material.

C type: Fine powdery ore and lime stone are mixed. An amount of the resulting mixture corresponding to 20% of the whole sintering material with its moisture adjusted is attached to the surface of the coarse powdery ore to form the intermediate layer. To this surface of the agglomerated particles the mixed powders of the remaining fine powdery iron ore and lime stone with the fine powdery coke are attached, with their moisture adjusted, so that the outer shell layer is formed.

P type: The NOx conversion rate (calculated by indicating in % the ratio of N in the material coke converted into the NO), the yield of the sintered product and the sintering productivity, in case of sintering the above materials of S, C and P types in a 60 Kg test pan, are shown in Table 9.

Table 9

| Kind of material | Conversion rate of NOx | Yield of sintered product | Sintering productivity |
|---|---|---|---|
| S Type | 55.2% | 68.1% | $1.35^{T/m3}$ H |
| C Type | 18.1 | 76.4 | 1.71 |
| P Type | 36.1 | 74.7 | 1.29 |
| Control (Particle size of present state) | 39.8 | 74.5 | 1.33 |

The C type of the sintering materials presently used has the double composite structure composed of a central nucleus and an outer shell layer. In this example, however, the simple powdery iron ore of the ordinary sintering ore materials was used. The concentration of the coke in the outer shell layer was made 10%. The nucleus particles were made of the central nucleus and an intermediate layer, the latter consisting of lime stone and fine powdery ore of not more than 1 mm and containing no coke. In the outside there was arranged the outer shell layer containing the fine powdery coke. Thus the three-fold composite structure was given.

It has been ascertained that this three-fold composite structure has little difference in effect of preventing NOx from the double or two-fold composite structure. As for the yield, it has been observed that the yield becomes lowered if the intermediate layer becomes too thick. Thus, what is meant by the "C type" should be the generic term including the three-fold as well as the two-fold.

It is now obvious from the above results that in case of S type, the conversion is high, while in case of C type, the conversion is low, showing considerable prevention of the emission of NOx. On the contrary, in case of the ordinary sintering material using the standard materials in which the content of C type is $\frac{1}{3}$ of the whole material, the conversion of NOx is in the order of 40% as shown in Table 5, which is clearly higher than that of the material consisting only of C type and P type.

In case of the C type sintering material which is most effective in preventing the emission of NOx, its effect of preventing NOx varies with the concentration of the coke in the outer shell layer.

The reason why the weight % of the coke which forms the S type particles in the entire coke should be limited to 20% or less is as follows.

Figure 2:
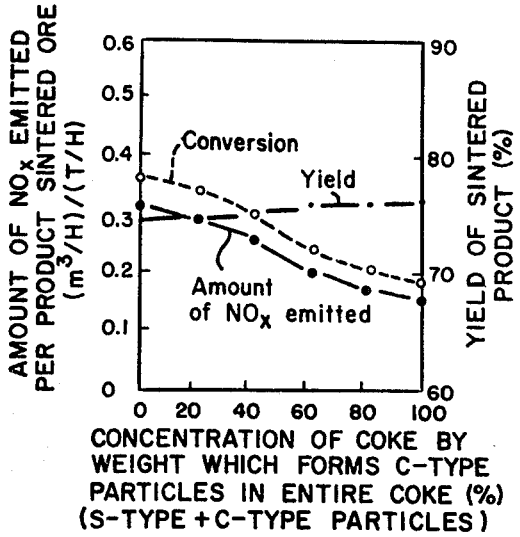
FIG. 2 is a graph depicting the result of the test for sintering of the mixed materials of the C type and the S type.

It is necessary for prevention of pollution to decrease the emission of NOx to below $\frac{2}{3}$ of the current emission, that is, below 0.23 $Nm^3$—NOx/t— sintered product. In order to study the acceptable content of the S type sintering material to the C type sintering material, the amount of NOx emitted and the yield in the manufacture of the sintered ore in a 60Kg test sintering pan are shown in FIG. 2. The result of FIG. 2 shows that if the amount of the S type material increases, the heat can not fully be transmitted to the ore particles, etc., and thereby the amount of molten liquid which serves to bind the ore particles is lessened. The yield is thus lowered. On the other hand, if the weight ratio of the coke which forms the C type particles in the entire coke becomes more than 80%, the yield of the sintered product becomes high and the amount of NOx emitted can be decreased down to $\frac{2}{3}$ or less of that produced by known methods. From the result set forth below, it can be concluded that the coke which forms the S type particles should be below 20% by weight of the entire amount of coke from the standpoint of ultimately lessing pollution.

The reason for the weight ratio (%) of the coke which is going to be C type particles in the entire Coke $\geqq 60 + 0.5$ {the weight ratio (%) of the coke which forms S type particles in the entire coke} is as follows.

Figure 3:
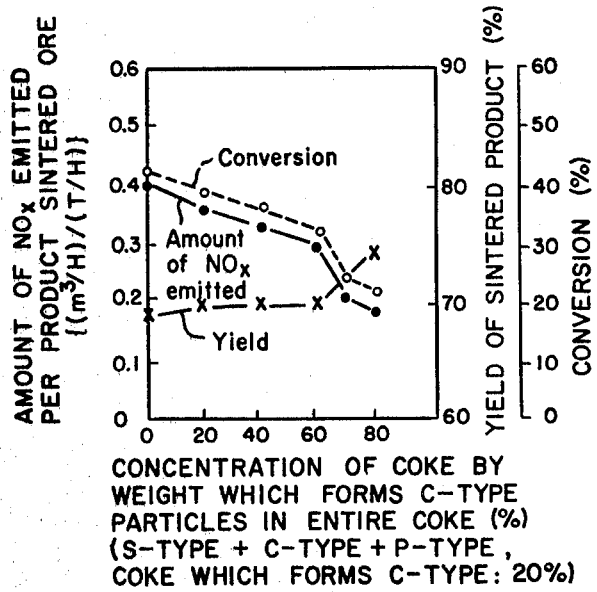
FIG. 3 is a graph depicting the result of the test for sintering of the mixed materials of the C type, the S type and the P type.

In the manufacture of the sintered ore using materials of S, C and P types shown in Table 8, fixing the weight ratio of the coke which forms S type particles in the entire coke to 20% and varying the ratio of C type and P type, the result of sintering the mixed materials of C, S and P types (the test of emission of NOx) is shown in FIG. 3. It shows that even if the weight ratio of the coke which forms C type particles in the entire coke is not 80%, but 70% and the weight ratio of the coke which forms the P type is 10%, the amount of NOx emitted per 1 ton of the product sintered ore can be controlled to the same level as that of the case that the coke which forms C particles is 80%. In other words, in case that the weight ratio of the coke which forms S type particles is 20% of the entire coke, the NOx emitted can be controlled to $\frac{2}{3}$ or less of that of known methods, so long as the weight ratio of the coke which forms C type particles is at least 70%.

Figure 4:
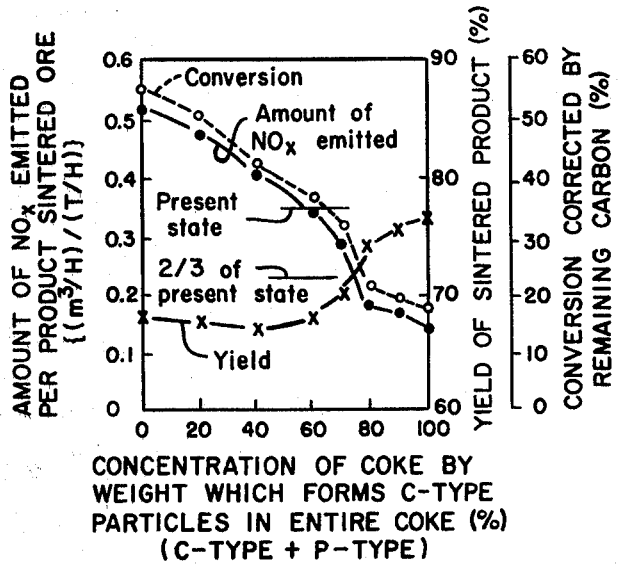
FIG. 4 is a graph depicting the result of the test for sintering of the mixed materials of the C type and the P type.

In FIG. 4 is shown the result of the sintering test of the mixed materials of C type and P type or the case that the weight ratio of the coke which forms S type particles is 0%, others being C type and P type. In this case, if the weight ratio of the coke which forms C type particles is 60% or more, the NOx emitted can be controlled to the same level as that of the case that the coke which is going to be C type particles is 80% and the coke which forms S type particles is 20%.

A method for the manufacture of the material according to the invention is described as follows.

Figure 5:
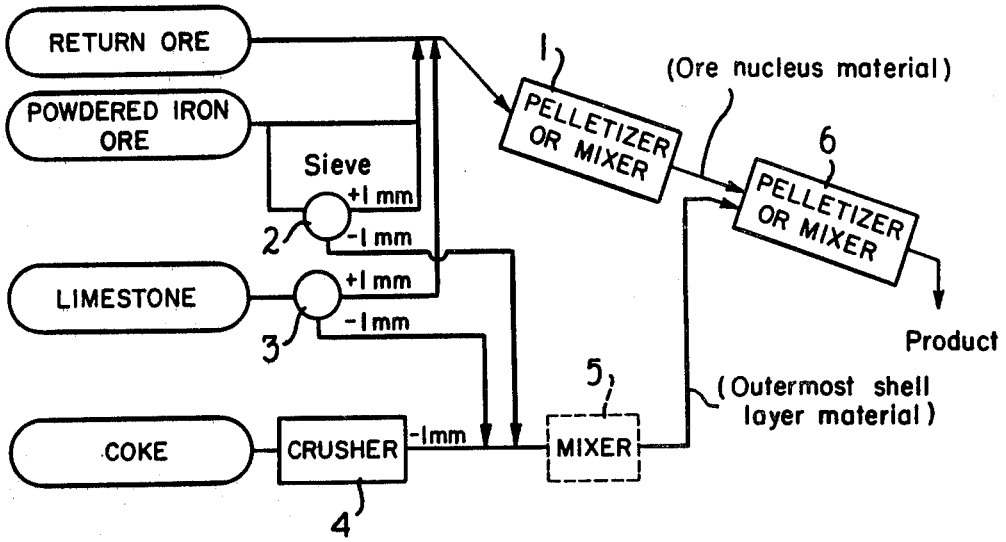

FIG. 5 illustrates one embodiment of the method of the invention. Three components, that is, (a) fines, (b) powdery iron ore and a part of powdery iron ore of +1 mm obtained by sieving or screening by the use of a 1 mm sieve or screen 2 and (c) lime stone of +1 mm obtained by sieving by the use of a 1 mm sieve 3 are mixed in the primary pelletizer or mixer 1 to provide an ore nucleus material. Coke is reduced to −1 mm by a crusher 4. The resulting coke is mixed in a mixer 5 with the −1 mm powdery iron ore passing through the sieve 2 and −1 mm lime stone passing through the sieve 3 to provide the outermost shell layer material. To the secondary pelletizer or mixer 6 are supplied said ore nucleus material and said outermost shell layer material to provide the sintering material of the invention.

In order to attain the desired value of the content of the coke in the outermost shell layer under the given content of the coke in the mixture, the pick-up amount and the sieving amount of the powdery iron ore is adjusted.

In the primary pelletizer, the operation is effected such that the −1 mm powders are attached to the +1 mm coarse particles. However, even if a part of the −1 mm powders is passed to the second pelletizer under condition of fine-powder-agglomerated particles having no nucleus, there is no difficulty caused for the formation of the outermost shell layer.

The lime stone can also be used after crushed to −1 mm. When the iron ore in which −1 mm particles are 100% (the fine powdery ore which has heretofore been considered as unsuitable for sintering may also apply thereto) can be used simultaneously, it is of course used as the outermost shell layer material.

Table 10

| Mixed material | Sample I Mixing ratio | Sample I Particle size (%) by weight +1 mm | Sample I Particle size (%) by weight −1 mm | Sample II Mixing ratio | Sample II Particle size (%) by weight +1 mm | Sample II Particle size (%) by weight −1 mm |
|---|---|---|---|---|---|---|
| Powdery iron ore | 61 | 40 | 60 | 65 | 20 | 80 |
| Fines | 25 | 85 | 15 | 20 | 85 | 15 |
| Lime stone | 10 | 55 | 45 | 10 | 0 | 100 |
| Coke | 4 | 0 | 100 | 4 | 0 | 100 |

Table 11

| Sample | Amount of NOx emitted ($Nm^3$/t) Conventional method | Present method* |
|---|---|---|
| I | 0.346 | 0.115 |
| II | (blanc) | 0.142 |

*The coke content in the outermost shell layer is 20%.

As shown in Tables 10 and 11, when the fine powders in the powdery iron ore increase so that the composite type material having a thick intermediate layer is formed, the sintering yield is lowered and the amount of NOx emitted per ton of the product is elevated. The fine-powder-agglomerated particles having no nucleus in the ore nucleus materials are 3% by number for the sample I and 5% by number for the sample II.

Another method according to the invention is as follows.

Figure 6:
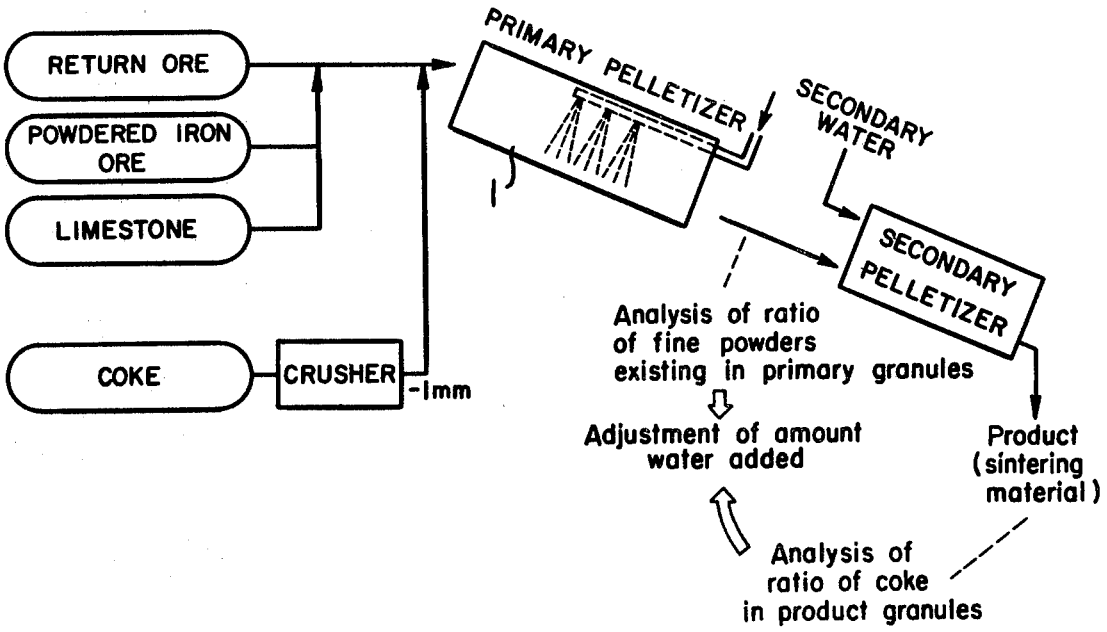

The coke used is obtained by crushing the same to −1 mm in order to obviate S type particles. The powdery iron ore, lime stone or other sintering materials used are those having ordinary particle size. As shown in FIG. 6, the various materials such as powdery iron ore, fines, lime stone and the powdery coke of −1 mm are then passed to the primary pelletizer or mixer 1 to granulate the same. In this case, it is necessary to add water in an amount which is less than the optimum amount so as to effect the granulation of the materials charged. The object of controlling the amount of water is to attach the fine powders preferentially to the +1 mm particles so that the growth of the P type particles caused by granulation of the fine powders can be prevented. The amount of secondary water added is adjusted so that, in the discharge (product granules) from the secondary pelletizer 6, the rate of distribution of the coke to the C type particles can be at least 60% of the whole coke. The adjustment of water added is effected based upon the result of analysis of the product granules. However, if the relation of the result of analysis of the product granules and the primary granules (semi-wet condition) is given, the adjustment of water added can be effected based upon the result of analysis of the primary granules.

The reason why the water is added in an amount less than the optimum amount is as follows.

If the powdery coke crushed to −1 mm is mixed with the powdery iron ore containing fine particles of −1 mm, to which is added the so-called optimum amount of water of the sintering material, so as to effect granulation, both the C type particles having +1 mm, coarse particles as the nucleus and the P type particles made by granulating −1 mm fine powders are manufactured. The rate of coke to be distributed to said P type particles is not less than 40% of the whole coke.

Figure 8:
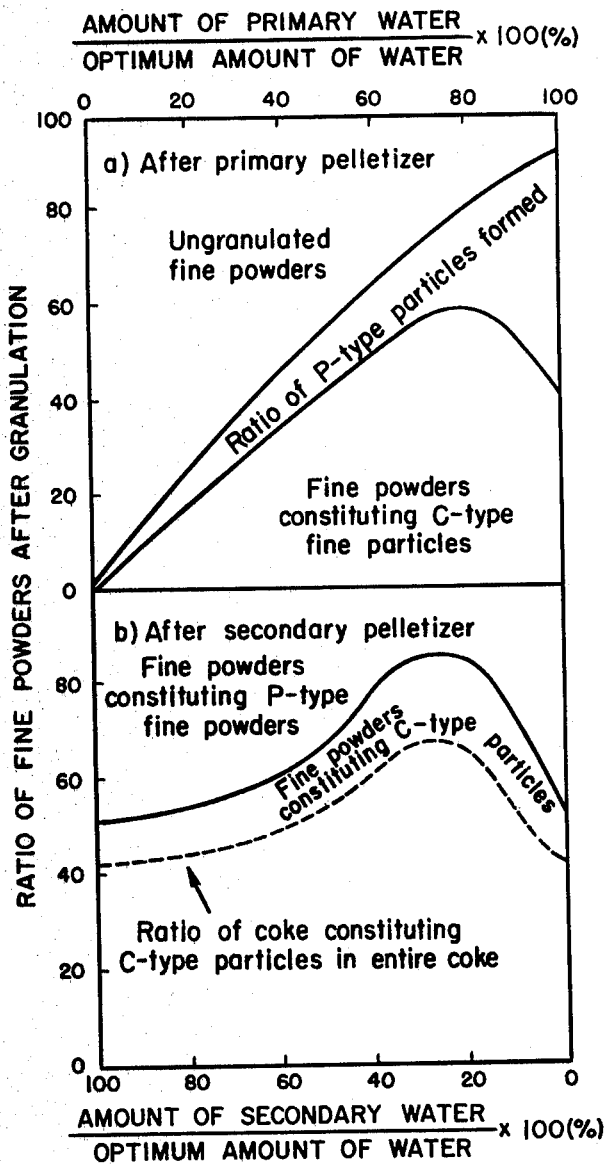
FIG. 8 shows the relation between the rate of water added (Amount of primary added water: Amount of optimum added water) in the primary pelletizer and the ratio of fine powders in the granules.

However, the sintering material in which the distribution rate of the coke to the P type particles is at least 40% has poor sintering yield and a high amount of NOx emitted. The study of the inventors reveals that the amount of water added has a close relation with the formation of the P type particles. This is shown in FIG. 8(a) with respect to the primary water added in the primary pelletizer 1 and the rate of ungranulated fine powders after granulation. The test sample for this case is as shown in Table 1.

According to FIG. 8(a), in case of addition of water less than 80% of the optimum amount, the rate of fine powders which form the primary P type particles is low. Thus, even if the P type particles are formed temporarily, they are easily destroyed in the course of rolling or tumbling since the amount of water is insufficient to form the strong bond of solid and liquid by filling the voids between the ore particles with the added water. On the other hand, in case of the C type particles having coarse particles as the nucleus, the attached fine powder layer is readily compacted because of the greater tumbling power and the voids are decreased so that a stronger bond layer of solid and liquid is formed. Of course, the amount of water which is extremely small can not produce granulation. In case of this test sample, the amount of water which is 60% of the optimum amount gives a very low yield of the granules (+1 mm), which results in that the amount of fine powders which form C type particles is lowered. The result of the test of granulation of such primary granules in the secondary pelletizer 6 is shown in FIG. 8(b), from which it is seen that the fine particles remaining in the primary granules are chiefly used for growth of C type particles. Accordingly, in order to preserve the fine powders which form C type particles at least at a predetermined ratio in the product granules, it is important to prevent the formation of P type particles and accelerate the formation of C type particles in the primary pelletizer, whereby the type-wise existing rate of coke in the product granules can be controlled.

Based upon the above result, it is possible even if the outer shell layer is brittle in the primary pelletizer or mixer 1 to make a product by making the C type particles (primary) which have strength enough to be charged into the secondary pelletizer 6, charging the discharge from the primary pelletizer 1 to the secondary pelletizer or mixer 6, and adding water for granulation. The operation of the secondary pelletizer 6 is conducted such that the outer shell layer of the primary C type particles which have been made by the primary pelletizer is attached with the remaining −1 mm particles as much as possible so as to make the outer shell layer thick and dense and thereby form strong particles which are not destroyed in the course of transportation and charge to the sintering machine. The secondary water added is used in an amount calculated by subtracting the amount of the primary water added from the optimum amount of water added. In this case, an addition of such binders as a suspension of bentonite, slaked lime, etc. will serve to strengthen the wet particles.

In this method, if the drum-type primary pelletizer 1 is used, it is desirable to effect the mixing and the granulation separately in the fore-half and the rear-half of the pelletizer. For this, the fore-half of the pelletizer is designed to have the function of mixer while the rear-half of the pelletizer is designed to effect granulation of the mixer with the water added from a shower.

EXAMPLE

The result of comparison of the method of the present invention and that of the prior art using the sample shown in Table 1 is indicated in Table 12.

Table 12

| Kind of method for sintering | −1 mm % in Test sample in Iron ore | −1 mm % in Test sample in Coke | Rate of distribution of water added (%) Primary | Rate of distribution of water added (%) Secondary | Rate of distribution of coke to composite type particles in product (%) | Result of sintering test: Yield (%) | Result of sintering test: Amount of NOx emitted ($Nm^3$/ton-product) |
|---|---|---|---|---|---|---|---|
| Conventional method | 45 | 58 | 100 | 0 | 35 | 74.3 | 0.346 |
| Method of this invention | 45 | 100 | 80 | 20 | 87 | 76.5 | 0.174 |

Remarks: Mixing ratio of coke: 3%

As set forth herein above, a material for sintering in which at least 60% of the total coke is distributed in a double-structural composite type particle having coarse ore particles as a central nucleus and fine powdery coke and ore as the outer shell layer can be obtained according to this invention. Also for the pellet-type particles having no central nucleus, the distribution of the coke can be controlled to 40% or less, and yet the amount of NOx emitted per ton of product can be decreased to $\frac{2}{3}$ of the amount which has been encountered in the prior art.

Figure 7:
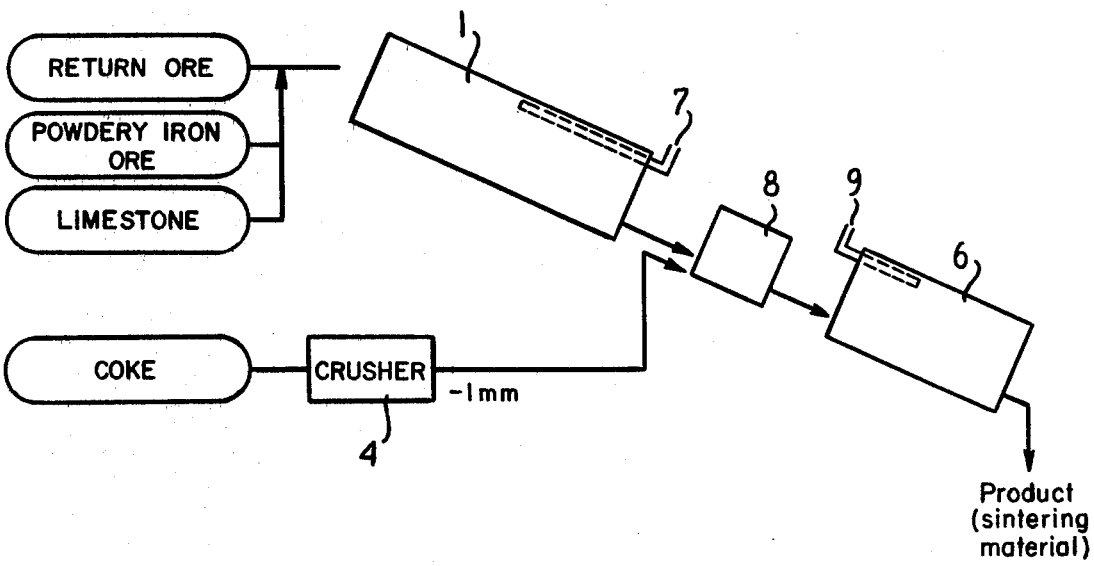
FIGS. 5 to 7 are flow sheets illustrating preferable embodiments of the invention.

Another method for the manufacture of the sintering material is shown in FIG. 7.

The primary water is added to the sintering material of powdery iron ore, lime stone, fines, etc. to granulate the same in the primary pelletizer 1. The resulting granules and coke of not more than 1 mm are charged into the secondary pelletizer 6, to which is added secondary water. The content in the pelletizer is then tumbled whereby the coke is diffused from the surface of the granules to the interior thereof. If, after the primary pelletizer, the granules and the coke of 1 mm or less are mixed in the mixer and then charged to the secondary pelletizer, the composite type particles can be obtained more easily.

In FIG. 7, the numeral 1 is the primary pelletizer, 7 is the primary sprinkling unit, 8 is the mixer, 6 is the secondary pelletizer, and 9 is the secondary sprinkling unit. Fines, powdery iron ore and lime stone which contain no coke are charged into the primary pelletizer 1 where they are granulated, to provide primary granules. In this region, an amount of water less than the optimum amount is added for the purpose of making the primary granules porous enough for the coke to be next added to migrate from the surface of the primary granules to the interior thereof in the secondary pelletizer 6.

After the primary pelletizer 1, the mixer 8 is arranged where the primary granules and fine powdery coke (−1 mm) to be newly added are mixed. At the same time the remaining amount of water calculated by subtracting the amount of the primary water from the optimum amount of water is also added. The fine powdery coke is attached to the surface of the primary granules. In the secondary pelletizer 6, the outer shell layer of granules is compacted by means of tumbling. In this course, fine powdery coke is pushed into the outer shell layer such that it may be diffused inside, which results in the formation of the composite type particles wherein the fine powdery coke has been diffused.

EXAMPLE

The result of the sintering test of the sintering materials manufactured by the method of the present invention and the prior art using samples as shown in Table 1 is indicated in Table 13.

Table 13

| Method of manufacture of sintering materials | −1 mm% in test sample | | Result of test for sintering | |
|---|---|---|---|---|
| | in Ore | in Coke | Yield (%) | Amount of NOx emitted ($Nm^3$/ t-product) |
| Conventional method | 45 | 58 | 74.3 | 0.346 |
| Method of this invention | 45 | 100 | 73.5 | 0.196 |

As explained above, the material for sintering which consists of composite particles wherein fine powdery coke has been diffused from the surface of agglomerated particles to the interior thereof can be obtained according to this invention, which makes it possible, after sintering the same, to decrease the amount of NOx emitted per ton of sintered ore product of $\frac{2}{3}$ or less of that produced by the prior art.

We claim:

1. A pellet for preparing a sintered ore for use in iron making operations, said pellet comprising as ingredients iron ore, fines, limestone and coke in particulate form and includes S type agglomerated particles wherein coke of at least 1 mm forms a first central nucleus and around said first nucleus there are fine powders of not more than 1 mm of all said ingredients, which attach to said first central nucleus and form an outer shell layer; C type agglomerated particles wherein the said ingredients of at least 1 mm other than coke form a second central nucleus and around the second nucleus fine powders of said ingredients not more than 1 mm other than coke attach to said second central nucleus and form an intermediate layer and further around said intermediate layer fine powders of not more than 1 mm of all of said ingredients attach and form an outer shell layer, or C type agglomerated particles wherein fine powders of not more than 1 mm of all said ingredients attach to said second central nucleus and form an outer shell layer, and satisfying the formulas {the weight ratio by percent of the coke to form C type particles in the entire coke} $\geqq$ (60 + 0.5 × {the weight ratio by percent of the coke to form S type particles in the entire coke}), and {the weight ratio by percent of the coke to form S type particles in the entire coke} $\leqq$ 20.

2. A method for preparing a pellet which is sintered for use in iron making operations which comprises crushing powdery coke to produce fine coke having a particle size of not more than 1 mm, granulating said fine coke with powdery iron ore, fines and limestone together with water in a primary pelletizing operation to produce C type composite particles while simultaneously preventing the formation of P type particles and mixing the discharge from the primary pelletizing operation with additional water in a secondary pelletizing operation to attach the ungranulated fine coke powder in said primary pelletizing operation discharge to the C type composite particles, the P type particles being agglomerated particles consisting essentially of powdery iron ore, powdery coke, powdery limestone and having no nucleus.

3. A method for preparing a pellet which is sintered for use in iron making operations said pellet comprising a core layer and an outer shell layer, which comprises adding water to powdery iron ore, limestone and fines, granulating the same in a primary pelletizing operation, and passing the resulting granules and coke of not more than 1 mm into a secondary pelletizing operation to mix the same with additional water to thereby diffuse the coke from the surface of the resulting outer shell layer of granules to the center thereof, forming a core layer in which no coke is present.

* * * * *

UNITED STATES PATENT AND TRADEMARK OFFICE

CERTIFICATE OF CORRECTION

PATENT NO. : 4,082,540

DATED : April 4, 1978

INVENTOR(S) : Minoru Sasaki, Yukihiro Hida, Tsuneo Enokido and Kaoru Ito

It is certified that error appears in the above-identified patent and that said Letters Patent are hereby corrected as shown below:

At Col. 7, lines 60-63, "C" of Table 8 should read as follows:--

| | | | | |
|---|---|---|---|---|
| Particle size | 1-5mm (average 3.1mm) | 1mm or less (average 0.13mm) | 1mm or less (0.17 mm) | 1mm or less (average 0.14mm) |

UNITED STATES PATENT AND TRADEMARK OFFICE

CERTIFICATE OF CORRECTION

PATENT NO. : 4,082,540

DATED : April 4, 1978

INVENTOR(S) : Minoru Sasaki, Yukihiro Hida, Tsuneo Enokido and Kaoru Ito

It is certified that error appears in the above-identified patent and that said Letters Patent are hereby corrected as shown below:

At Col. 8, lines 1-5, the last line of table with the heading should read as follows:--

| Type | Coarse powdery ore | Fine powdery ore | Lime stone | Coarse powdery coke | Fine powdery coke |
|---|---|---|---|---|---|
| Mixing ratio | 0 | 85% | 10% | 0 | 4% |

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*